US005113683A

United States Patent [19]

Lafrasse

[11] Patent Number: 5,113,683

[45] Date of Patent: May 19, 1992

[54] PIPE BENDING MACHINE HAVING TWO BENDING HEADS

[75] Inventor: Jean Lafrasse, Dardilly, France

[73] Assignee: Eaton Leonard Picot S.A., Tassin la Demi Lune, France

[21] Appl. No.: 645,974

[22] Filed: Jan. 25, 1991

[30] Foreign Application Priority Data

Jan. 26, 1990 [FR] France ..... 90 01574

[51] Int. Cl.[5] ..... B21D 7/022

[52] U.S. Cl. ..... 72/306; 72/217

[58] Field of Search ..... 72/306, 305, 311, 323, 72/321, 217-219, 388, 387

[56] References Cited

U.S. PATENT DOCUMENTS

| | | | |
|---|---|---|---|
| 4,485,658 | 12/1984 | Stewart | 72/149 |
| 4,662,204 | 5/1987 | Saegusa | 72/306 |
| 4,702,097 | 10/1987 | Zahlaus | 72/306 |
| 4,945,747 | 8/1990 | Yogo | 72/306 |

FOREIGN PATENT DOCUMENTS

| | | | |
|---|---|---|---|
| 349953 | 1/1990 | European Pat. Off. | 72/306 |
| 3620151 | 2/1987 | Fed. Rep. of Germany | 72/306 |
| 293920 | 11/1989 | Japan | 72/306 |

*Primary Examiner*—Daniel C. Crane
*Attorney, Agent, or Firm*—Browdy and Neimark

[57] ABSTRACT

A pipe bending machine having two bending heads is endowed with two bending heads (9, 10), that each can move in the initial direction of pipe to be bent (12), each also being endowed with a bending tool that operates in a bending plane whose orientation can be modified. At least one of the bending heads (9, 10) can also move in a plane perpendicular to the initial direction of pipe (12) and holds clamping mechanism (27, 29) of the pipe, offset from the longitudinal axis of the head. In this way the head can be moved away from initial axis (11) of the pipe, the associated clamping mechanism (27, 29) in this case moving into such axis and being able to hold pipe (12) temporarily therein. This arrangement makes it possible to execute very closely-spaced bends in the median area of the pipe.

7 Claims, 4 Drawing Sheets

FIG. 1
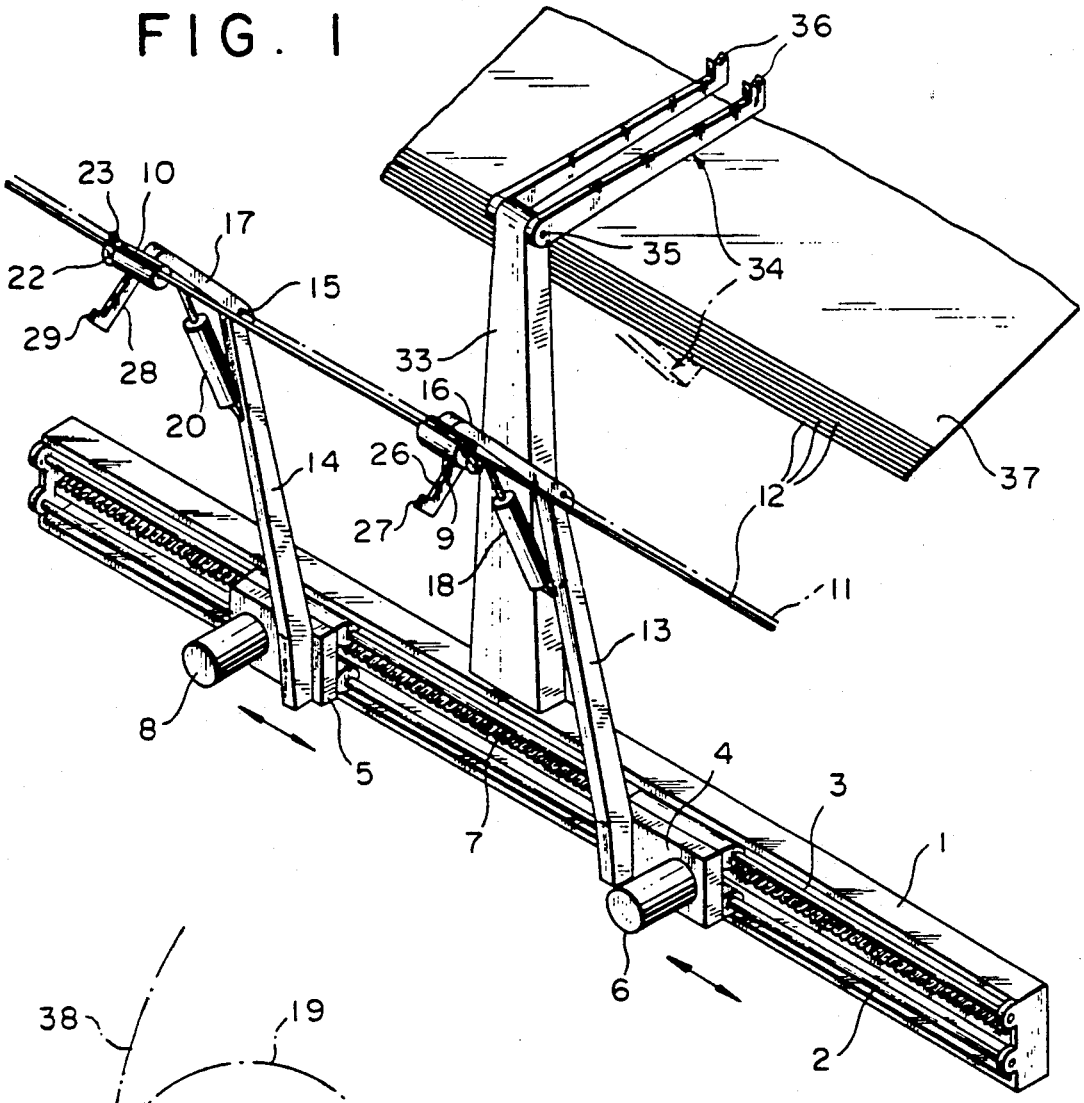
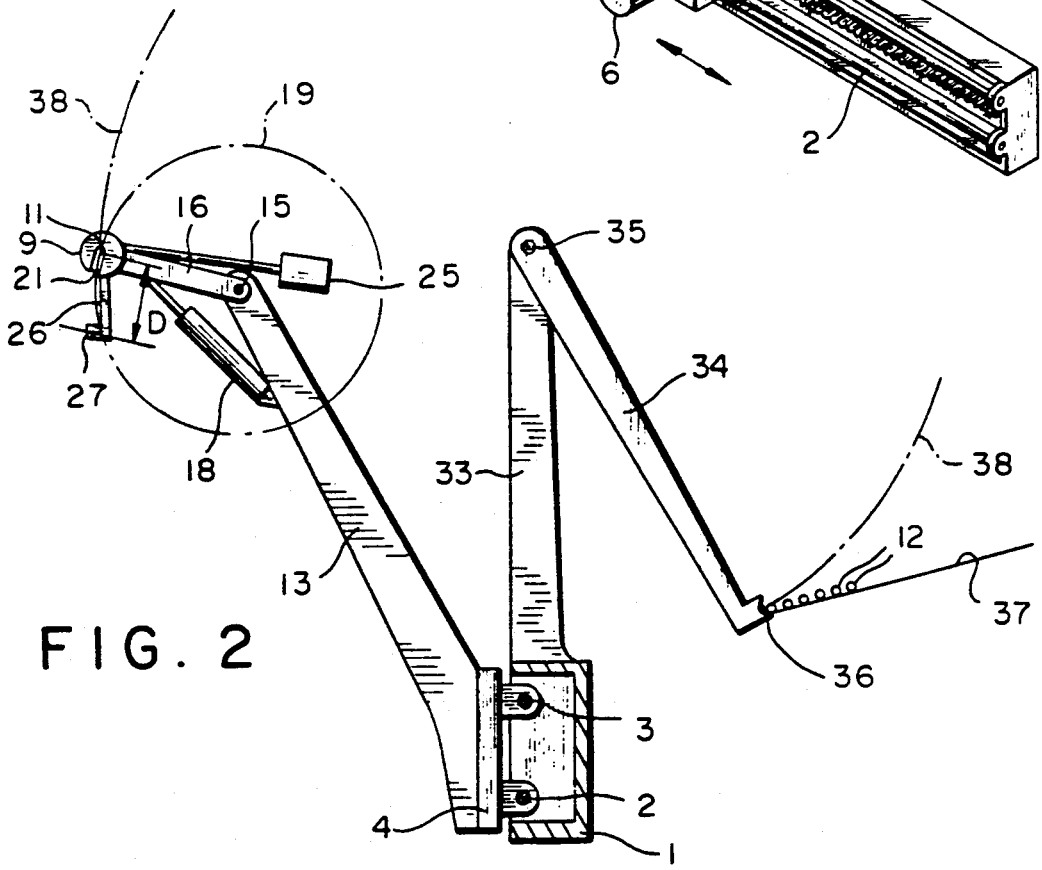
FIG. 2

PIPE BENDING MACHINE HAVING TWO BENDING HEADS

FIELD OF THE INVENTION

This invention pertains to a pipe bending machine. More specifically, this invention pertains to a machine endowed with two bending heads, each of which can be moved in the initial direction of the pipe to be bent, and each of which is endowed with a bending tool that operates in a bending plane whose orientation can be modified by the action of a control mechanism and can be different from the orientation of the bending plane in which the other bending head is operating.

BACKGROUND OF THE INVENTION

Pipe bending machines of this type and rotating bending heads adapted to said machines have been described, for example, in French Patent Application No. 2 610 852, or in European Patent Application No. 0 281 488 in the name of the Applicant.

In such known bending machines, the two bending heads are normally placed on either side of a fixed or rotating central clamp designed to hold the pipe to be bent. During the bending process, the two bending heads, operating simultaneously or alternatingly, are moved progressively towards the central clamp, each bending head allowing several successive bends to be made in the corresponding half of the pipe, and the different bends possibly being located in different planes from each other. It is understood that bending machines of this type allow multiple bends to be made efficiently in relatively long pipes, and, accordingly, said machines have applications primarily in the automobile industry, for example, for making brake system conduits.

Nonetheless, said pipe bending machines still present problems that limit their possibilities for use. In particular, it is still difficult if not impossible to make closely-spaced bends in a median area of the pipe because the central clamp is usually present. Indeed, said median area is gripped in the central clamp, which is an obstacle that limits the translation movement by which the two bending heads move together. Thus, unless special arrangements are provided, the minimum distance between two bends in the median area of the pipe is equal to at least twice the length of a bending head plus the width of the central clamp.

The mere elimination of said central clamp is not a valid solution to the above problem because the pipe still has to be held when the last bend(s) is (are) made in its median area.

SUMMARY OF THE INVENTION

This invention aims to eliminate the problems of the prior art by providing a pipe bending machine that makes it possible to make very closely-spaced bends in the median area of the pipe, while still ensuring that the pipe is immobilized properly.

For this purpose, an object of the present invention is a pipe bending machine with two bending heads. At least one of the two bending heads is constructed also to move in a plane perpendicular to the initial direction of the pipe to be bent, and comprises a mechanism to clamp said pipe that is offset from the longitudinal axis of the bending head so that said bending head can be moved away from the initial axis of the pipe to be bent, with the associated clamping mechanism in this case moving into said axis and being able to hold the pipe to be bent temporarily therein.

In this way, the pipe bending machine according to the invention has no central clamp, and its operation is equally effective: its two bending heads are activated alternatingly, one of the heads making a bend in the pipe in the desired bending plane while the other head holds said pipe. When the two bending heads reach the median area of the pipe, one of the heads can retract, for example, to the rear of said pipe, so that it no longer prevents the other bending head from moving further forward so that a last bend can be made very close to the previously made bend. While the other bending head makes the last bend, the pipe is gripped by the clamping mechanism held by the clamping head that was moved away from the initial axis of the pipe.

The two bending heads of the machine are preferably both provided in a plane perpendicular to the initial direction of the pipe to be bent so that they each can be moved away from the initial axis of the pipe to be bent, and each bending head holds a mechanism to clamp said pipe, said mechanism being offset from the longitudinal axis of said head.

According to one embodiment of the invention, each bending head is held by the free end of a support arm mounted to pivot around an axis parallel to the initial direction of the pipe to be bent, on a part of a carriage that itself can be moved in said direction. A motorized control mechanism is provided to activate the pivoting support arm to move the corresponding bending head away from the initial axis of pipe to be bent or to move said bending head back to said axis. In this case, the motorized control mechanism can be composed of a jack mounted between a part of the carriage and the pivoting support arm of the bending head.

In one embodiment of the invention, each bending head itself is endowed towards its end located on the side of its bending tool with a support rod substantially perpendicular to the initial direction of the pipe to be bent, the free end of said support rod being endowed with the aforementioned clamping mechanism. The latter can be made in the form of a clamp having two opposite jaws pivoting symmetrically under the action of a motorized control mechanism. The distance between the clamp and the longitudinal axis of the bending head defines the distance by which said head must be offset to bring the clamp into its active position, in which it can temporarily hold the pipe to be bent.

The clamping mechanism can be mounted in a fixed manner on the associated bending head. The mechanism can also be constructed to be retractable so that it is not in the way when not in use, and primarily so that it does not interfere with the spring movement of the pipe during the bending operation.

BRIEF DESCRIPTION OF THE DRAWINGS

In any event, the invention will be more clearly understood through the description below, with reference to the accompanying schematic drawings that shows the preferred embodiment of said pipe bending machine as a non-restrictive example:

FIG. 1 is an overall perspective view of a pipe bending machine having two bending heads according to the present invention;

FIG. 2 is a partial cut end view of the machine of FIG. 1, showing a bending head in normal operating position;

DETAILED DESCRIPTION OF THE PREFERRED EMBODIMENTS

Figure 3:
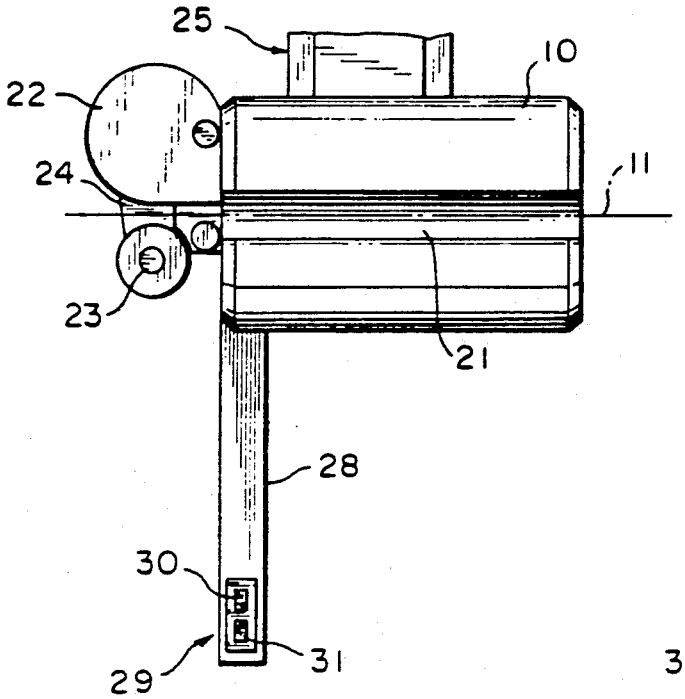
FIG. 3 is a side view of a bending head of the machine of FIG. 1.

The pipe bending machine shown generally in FIG. 1 comprises a horizontally-elongated frame or rack 1. Frame 1 comprises two parallel horizontal guide columns 2 and 3 along which two carriages 4 and 5 can move in translation. First carriage 4 is endowed with a geared motor 6 that controls its movement along guide columns 2 and 3 through the intermediary of a pinion (not shown) that is coupled with a horizontal rack bar 7 held by rack 1. Second carriage 5 is also endowed with a geared motor 8 controlling its movement along guide columns 2 and 3 through the intermediary of a pinion that is coupled with the same rack bar 7.

First carriage 4 holds a first bending head 9, and second carriage 5 holds second bending head 10, the two bending heads 9 and 10 normally being positioned along the same horizontal axis 11 along which the initially-straight pipe to be bent 12 is also placed. In this way, by moving respective carriages 4 and 5, the two bending heads 9 and 10 can each be moved horizontally in the initial direction of pipe to be bent 12.

More specifically, and with reference also to FIG. 2, each carriage 4 or 5 comprises an upwardly-turned part, respectively 13 or 14. A support arm respectively 16 or 17 is mounted at the top of said part 13 or 14 to pivot around a horizontal axis 15 parallel to the initial direction of pipe to be bent 12. First bending head 9 is held by the free end of pivoting support arm 16 associated with first carriage 4 and second bending head 10 is held by the free end of pivoting support arm 17 associated with second carriage 5.

A jack 18 is mounted between part 13 of first carriage 4 and a point of associated support arm 16, to control a pivoting of said support arm 16 around axis 15, and in this way to move first bending head 9 on a circular path 19 in a plane perpendicular to the initial direction of pipe to be bent 12. In this way, first bending head 9 can be moved away from initial axis 11 of the pipe to be bent.

Likewise, another jack 20 is mounted between part 14 of second carriage 5 at a point of associated support arm 17, to control a pivoting of said support arm 17 around axis 15, and in this way to move a second bending head 10 on a circular path in a plane perpendicular to the initial direction of pipe to be bent 12. Second bending head 10 can thus also move away from initial axis 11 of the pipe to be bent.

Figure 4:
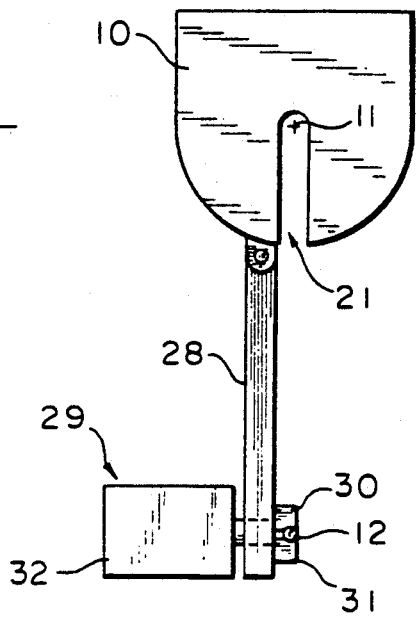
FIG. 4 is an end view of the bending head of FIG. 3.

With reference also to FIGS. 3 and 4, each bending head 9 or 10 has a cylindrical body containing a longitudinal slit 21 that allows pipe to be bent 12 to be introduced and removed laterally. At its outside end, i.e., the end away from the other head, each holding and bending head 9 or 10 comprises a bending tool of a known type, composed substantially of a shaping roller 22 and a bending roller 23, the latter being held by a pivoting radial arm 24 and thus being able to rotate around shaping roller 22. The entire holing and bending tool is mounted to rotate around the longitudinal axis of bending head 9 or 10 in order to change the orientation of the bending plane. The motorized command mechanism generally labelled 25 in FIGS. 2 and 3, which can include two geared motors and mechanical transmission components, is constructed on the one hand to change the orientation of the bending plane and, on the other hand, to activate radial arm 24 thereby producing the desired holding or bending of pipe 12. For the detailed structure of such a rotating bending head and its control components, reference can advantageously be made to the description and Figures of European Patent Application No. 0 281 488 in the name of the Applicant.

The body of first bending head 9 is endowed on the side of the bending tool with a support rod 26 substantially perpendicular to the longitudinal axis of said head and the direction of support arm 16 of said head 9. At its free end, support rod 26 is endowed with a clamping mechanism generally labelled 27.

In a symmetric manner, the body of second bending head 10 is endowed on the side of the bending tool with a support rod 28 substantially perpendicular to the longitudinal axis of said head and the direction of support arm 17 of said head 10. At its free end, support arm 28 is endowed with clamping mechanism generally labelled 29.

As shown primarily in FIG. 4, clamping mechanisms 27 or 29 can be made in the form of a clamp having two opposite jaws 30 and 31, which can pivot symmetrically between an open and closed position under the action of the motorized control mechanism 32. The clamp is constructed to grasp pipe to be bent 12 between its two jaws 30 and 31. The letter D (see FIGS. 2, 7 and 10) is used to indicate the distance between said clamp and the longitudinal axis of the bending head.

Figure 10:
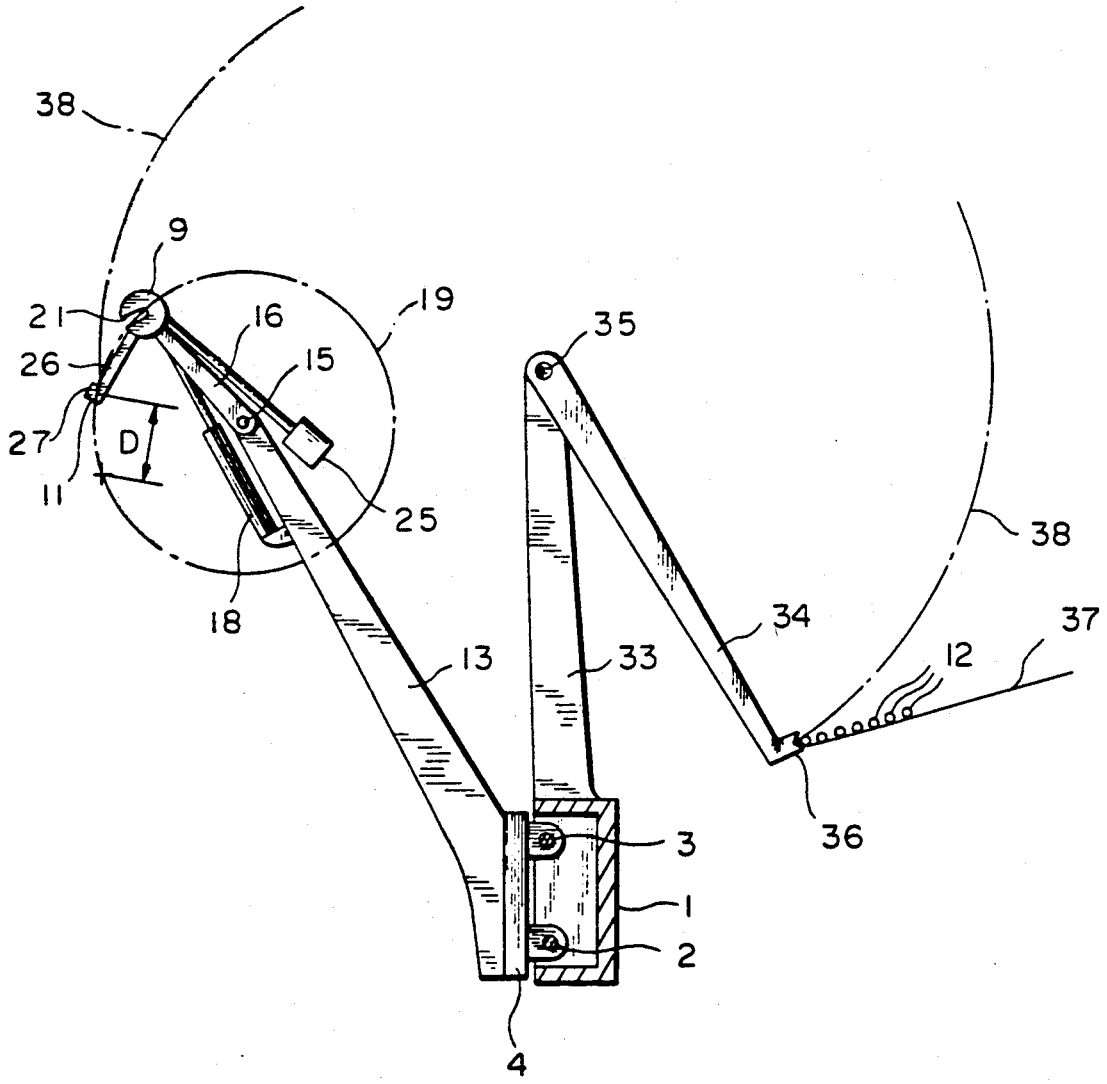
FIG. 10 is an end view similar to FIG. 2 but showing the bending head of the machine of FIG. 1 in position moved away from the initial axis of the pipe to be bent.

In the example embodiment under consideration, again with reference to FIGS. 1 and 2, the bending machine further comprises an automatic handling device. The handling device comprises a support foot 33 attached to the center of rack 1 and holding a double loading arm 34 mounted to pivot around a horizontal axis 35 parallel to initial axis 11 of the pipe to be bent. Gripping mechanisms 36, magnetic for example, constructed to hold a pipe, are provided at the ends of the branches of double loading arm 34. Pipes 12 on standby rest on an inclined plane 37. Double loading arm 34 takes the pipe 12 located at the lowest point of inclined plane 37 and moves said pipe in a circle arc 38 to axis 11 along which the two bending heads 9 and 10 normally move. Said heads 9 and 10 in this case are moved apart as shown in FIG. 10 and are far enough apart to allow double loading arm 34 to pass through them (or, if necessary, close enough together to allow the two loading arms to pass on either side of the two heads 9 and 10).

The two bending heads 9 and 10 in this case are returned to axis 11 to receive pipe to be bent 12. Said heads 9 and 10 are then moved apart, towards the ends of pipe 12, which allows them to stop against end pieces or nuts provided at the ends of pipe 12. Finally, double arm 34 of the handling device is returned to its starting position at the lowest point of inclined plane 37, if it has not already been retracted.

Next, the two bending heads 9 and 10, remaining in normal operating position on axis 11 (see FIG. 2), are moved alternatingly in the same direction along said axis 11 to hold and make bends alternatingly in the two halves of pipe to be bent 12. While one bending head 9 or 10 makes a bend of the desired angle in the corresponding half of the pipe according to a bending plane determined by the orientation of its bending tool, the other bending head 10 or 9 holds the corresponding half of pipe 12. One of bending heads 9 or 10 also holds pipe 12 during the bending operation while the other head is moved along axis 11. This alternating bending process can continue until the two heads 9 and 10 are positioned next to each other, as shown in FIG. 5, in the median area of pipe 12.

Figure 5:
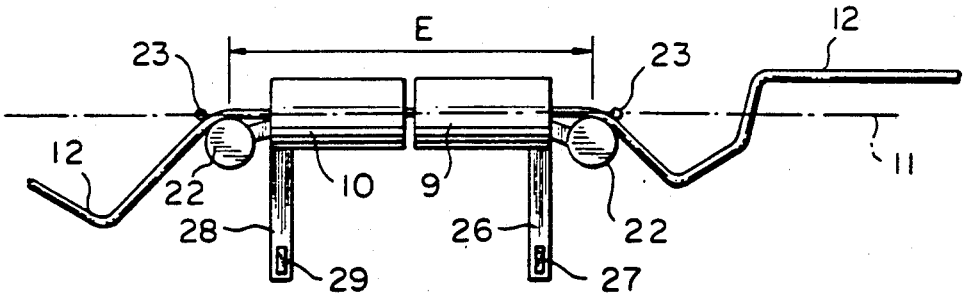
FIGS. 5, 6, 7, 8 and 9 are diagrams illustrating the operation of the machine of FIG. 1 for making closely-spaced bends in the median area of a pipe.

FIG. 5 shows that the last two bends that can be made in pipe 12 using the respective bending tools of the two heads 9 and 10 in this case are separated at least by a distance E, which is substantially equal to twice the length of a bending head.

Figure 6:
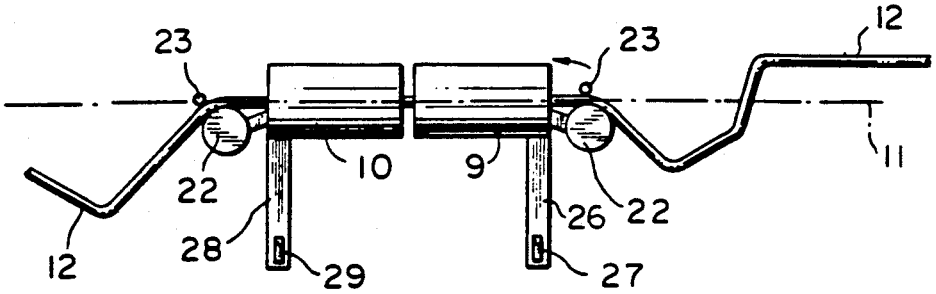

To make at least one additional bend in the median area of the same pipe 12, bending roller 23 of first head 9, for example, is first returned to its starting position (corresponding to a nil bending angle) as shown in FIG. 6.

Figure 7:
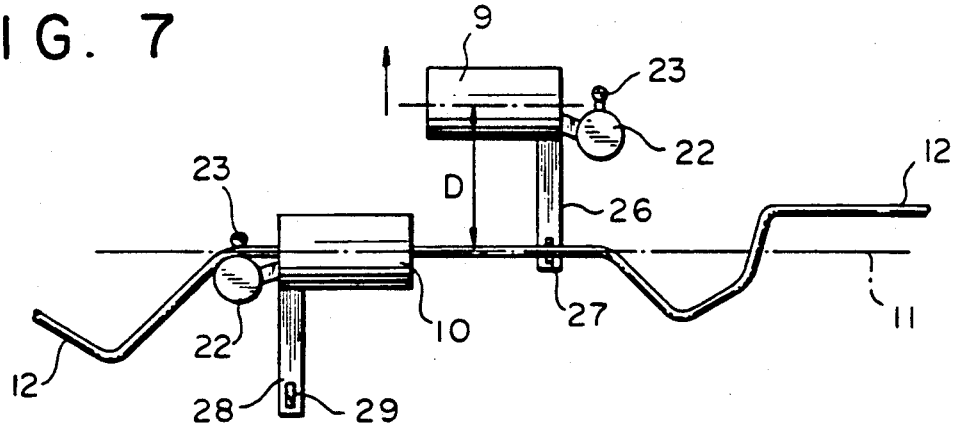

Next, as illustrated in FIGS. 7 and 10, first bending head 9 is moved away from initial axis 11 of pipe 12 over a distance D so that clamping mechanism 27 held by said head 9 moves to axis 11. This is accomplished, as noted early, by selective movement of jack 18 to pivot support arm 16 on circular path 19 the distance D, until support rod 26 carried on arm 16 brings clamps 27 into contact with pipe 12. Clamping mechanism 27 is activated in this case to hold pipe 12 firmly in its straight part located between the last two bends formed. Also, as previously noted, one of the bending heads 10 can hold pipe 12 until the clamps 27 engage pipe 12.

Figure 8:
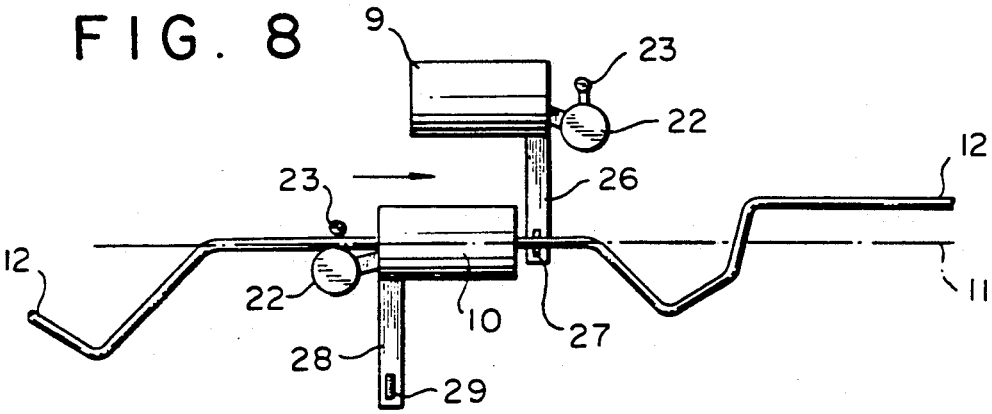

Second bending head 10 is next moved along axis 11 after its hold on pipe 12 is released towards clamping mechanism 27 without meeting any obstacles because first head 9 has already retracted. Said additional movement is illustrated in FIG. 8.

Figure 9:
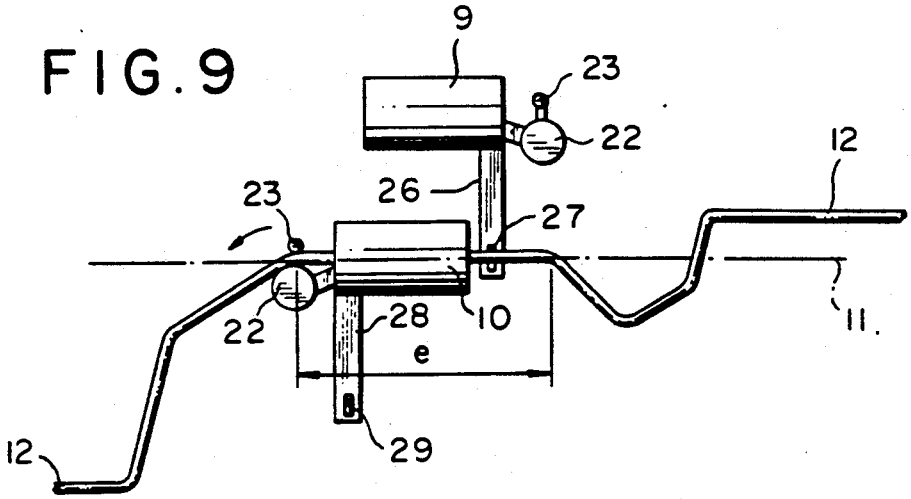

Finally, an additional bend is made in pipe 12 using second bending head 10, moved towards clamping mechanism 27 as shown in FIG. 9. In this way, the last two bends made in pipe 12 are separated by distance e which is clearly smaller than distance E and which can be approximately equal to half of distance E.

Of course, depending on the symmetry of the machine, the roles of the two bending heads 9 and 10 can be reversed in the above-described process.

Obviously, the invention is not limited solely to the embodiment of said pipe bending machine described above as an example; on the contrary, it encompasses all variations following the same principle. In this way, we would not depart from the framework of this invention by using any equivalents, primarily for mechanisms to control different movements, or furthermore by providing additional arrangements such as a system for retracting pipe clamping mechanisms held by the bending heads.

The foregoing description of the specific embodiments will so fully reveal the general nature of the invention that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation.

What is claimed is:

1. A pipe bending machine for bending a pipe (12) loaded on said machine along a longitudinal axis (11) of said machine which is coaxial to the initial longitudinal axis of said pipe (12) loaded on said machine, said machine comprising, two bending heads (9, 10) mounted on track means (1-8, 13, 14) for moving said heads along a direction parallel to said longitudinal axis (11) of said machine, each of said two bending heads having hold and bending means (22, 23, 24) for selectively holding and bending said pipe (12) loaded on said machine while holding said pipe in said longitudinal axis (11), control means (25) associated with said holding and bending means (22, 23, 24) for actuating said holding and bending means (22, 23, 24), each of said two bending heads (1, 10) having rotating means (15, 16, 17, 18, 20) engaged to said track means for selectively rotating each of said two bending heads about said longitudinal (11) axis in a plane (19) perpendicular to said longitudinal axis (11), each of said two bending heads (9, 10) having clamping means (26, 27, 28, 29) offset from said two bending heads (9, 10) for selectively engaging said pipe (12) loaded on said machine for bending after one of said rotating means (15, 16, 17, 18, 20) has moved a corresponding one of said two bending heads in a direction transverse to said longitudinal axis (11) of said machine and in a direction away from both said pipe (12) loaded on said machine and said longitudinal axis (11), and a remaining one of said two bending heads bends said pipe (12) loaded on said machine after one of said clamping means (26, 27, 28, 29) on said corresponding one of said two bending heads has engaged said pipe (12) loaded on said machine.

2. The machine of claim 1, wherein said rotating means (15, 16, 17, 18, 20) comprises, a first end of a first support arm (16, 17) engaged to a corresponding one of said two bending heads (9, 10), a second end of said first support arm (16, 17) pivotedly mounted on said track means (1-8, 13, 14), jack means (18, 20) pivotedly engaged to said track means (1-8, 13, 14) and to said first support arm for rotating said first support arm and said corresponding one of said two bending heads (9, 10) in a plane (19) perpendicular to said longitudinal axis (11).

3. The machine of claim 2, wherein said track means comprises, the first ends of each of two second support arms (13, 14) respectively pivotedly engaged to each said second end of said first support arm, the second ends of said each of two second support arms (13, 14) respectively mounted on each of two moveable carriages (4, 5), said two carriages slideably engaged to a base having a track parallel to said longitudinal axis (11).

4. The machine of claim 2, wherein said holding and bending means (22, 23, 24) are located at two opposite ends of said two bending heads.

5. The machine of claim 1 wherein said clamping means comprises, a first end of a support rod (26, 28) engaged to each of said two bending heads, said support rod being substantially perpendicular to said longitudinal axis (11), two opposite jaws (30, 31) pivoting symmetrically under the action of a motorized control mechanism (32) engaged to a second free end of said support rod (26, 28).

6. The machine of claim 1, wherein said clamping means is mounted in a fixed manner on said each of said two bending heads (9, 10).

7. The machine of claim 1, further comprising a first end of a loading arm (34) rotatably mounted to said track means, a second end of said loading arm having means for engaging a pipe (12) for loading on said machine, slits (21) on said two bending heads located to receive said pipe (12) for loading on said machine, wherein, when said two bending heads (9, 10) are rotated in one direction a selected distance, said loading arm (34) engaged to said pipe (12) for loading is rotatable to longitudinal axis (11) and said two bending heads are rotatable back in said one direction to receive said pipe (12) for loading in said slits (21), whereby, said pipe (12) for loading is loaded on said machine by engaging said holding and bending means.

* * * * *